United States Patent [19]

Good

[11] Patent Number: 4,620,611

[45] Date of Patent: Nov. 4, 1986

[54] SAFETY RAIL MEANS FOR LADDERS

[75] Inventor: John C. Good, Rosslyn Park, Australia

[73] Assignees: Robert Henry Haysom; David James Lindsey, both of Salisbury South, Australia

[21] Appl. No.: 807,366

[22] Filed: Dec. 10, 1985

[30] Foreign Application Priority Data

Dec. 14, 1984 [AU] Australia ..... PG8585

[51] Int. Cl.[4] ..... E06C 7/18

[52] U.S. Cl. ..... 182/106; 182/116

[58] Field of Search ..... 182/106, 113, 129, 116; 248/210

[56] References Cited

U.S. PATENT DOCUMENTS

| | | | |
|---|---|---|---|
| 736,495 | 8/1903 | Cloud | 182/106 |
| 922,306 | 5/1909 | Mead | 182/106 |
| 2,203,445 | 6/1940 | Schwarz | 182/106 |
| 2,533,391 | 12/1950 | Miller | 182/106 |
| 3,139,155 | 6/1964 | Skeels | 182/106 |
| 4,293,055 | 10/1981 | Hooser | 182/106 |
| 4,295,544 | 10/1981 | Peterson | 182/106 |

FOREIGN PATENT DOCUMENTS

| | | | |
|---|---|---|---|
| 1002392 | 8/1965 | United Kingdom | 182/106 |

*Primary Examiner*—Reinaldo P. Machado

*Attorney, Agent, or Firm*—Brown, Martin, Haller & Meador

[57] ABSTRACT

A ladder comprises a ladder portion having stiles and rungs, a platform at the upper end of the ladder portion, support stays hinged to the rear end of the platform, and a safety rail also hinged to the rear end of the platform, and that invention is characterized in that the safety rail can occupy one of two positions, and when in its retracted position it projects forwardly of the platform thereby inhibiting use of the platform.

5 Claims, 3 Drawing Figures

SAFETY RAIL MEANS FOR LADDERS

This invention relates to safety rail means for ladders of the type which incorporate platforms at their upper ends, for example for use in bulk stores, around aircraft, in domestic or industrial premises or the like.

BACKGROUND OF THE INVENTION

The use of safety rails on ladders having platforms at their upper ends is extremely desirable and in many cases it is mandatary, but there is a tendency for operators to become careless and not make use of such safety rails. In some instances the safety rails can be welded in position, and therefore are always available for use, but when so welded such safety rails impart limitations to the usability of a ladder, which is frequently required to be used in buildings having relatively low ceilings and door heights.

BRIEF SUMMARY OF THE INVENTION

A ladder comprises a ladder portion having stiles and rungs, a platform at the upper end of the ladder portion, support stays hinged to the rear end of the platform, and a safety rail also hinged to the rear end of the platform, and that invention is characterised in that the safety rail can occupy one of two positions, and when in its retracted position it projects forwardly of the platform thereby inhibiting use of the platform.

More specifically, the invention consists of a ladder comprising a ladder portion having stiles, rungs extending between the stiles, a platform joining the upper ends of the stiles and extending rearwardly therefrom, support stays, first hinge means joining the upper ends of the support stays to the rear end of the platform, a safety rail, further hinge means also joining the safety rail in the rear end of the platform so that the safety rail is movable between an in-use position where it extends upwardly from said platform rear end, and a retracted position where it projects forwardly of the platform.

The safety rail is necessarily higher than the platform is long, and overlies the platform when retracted, so that the safety rail projects into the path of an ascending operator and it becomes necessary for the rail to be positioned into its in-use (safe) position. This safe position can be retained by latch means which are spring loaded to inhibit inadvertent release.

BRIEF DESCRIPTION OF THE DRAWINGS

An embodiment of the invention is described hereunder in some detail with reference to, and is illustrated on, the accompanying drawings, in which.

Figure 1:
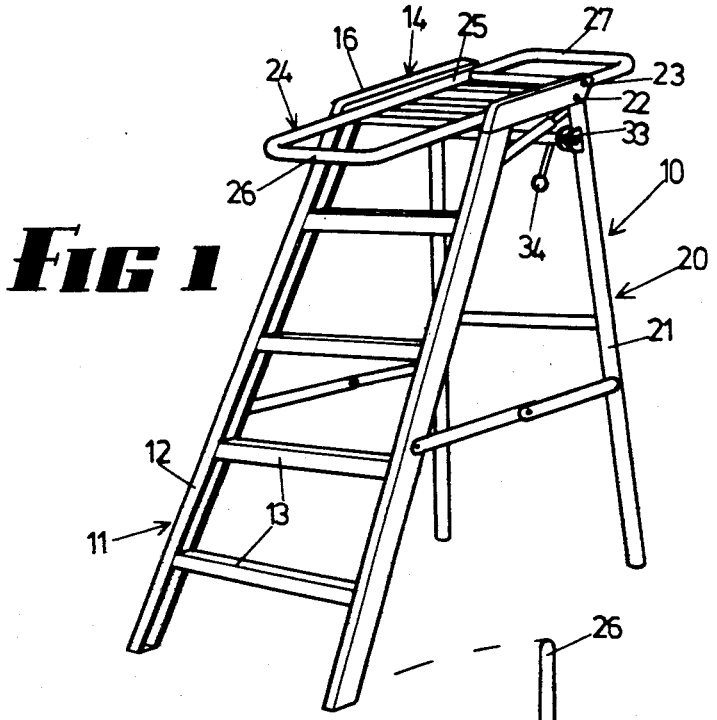
FIG. 1 is a perspective view of a ladder.
Figure 2:
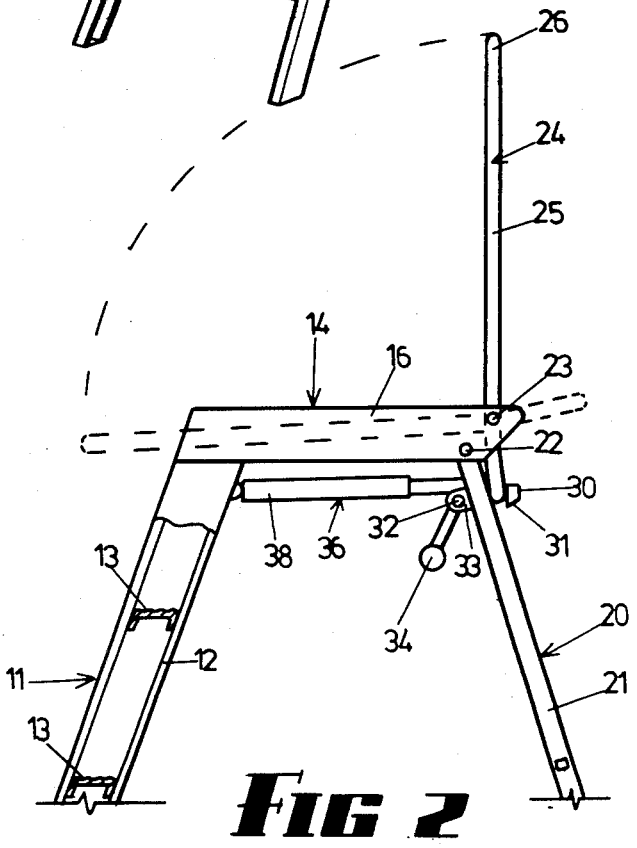
FIG. 2 is a fragmentary, partly sectioned, side elevation of the platform and safety rail thereof, drawn to a larger scale.
Figure 3:
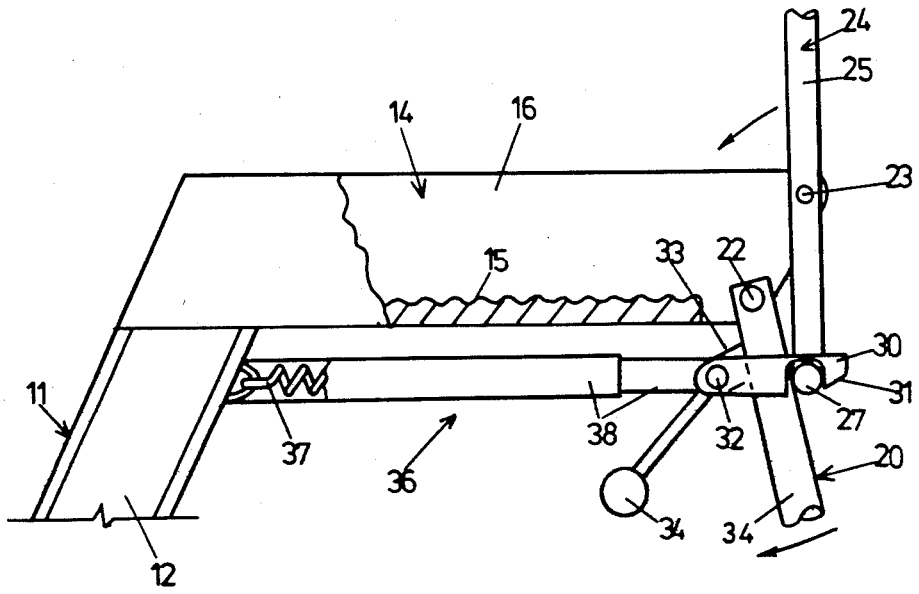
FIG. 3 is a further fragmentary, partly sectioned, view of same to a larger scale, and illustrating a latch arrangement.

In the embodiment herein illustrated, a ladder 10 comprises a ladder portion 11 having stiles 12 and rungs 13 therebetween, and the upper end of the ladder portion has a rearwardly extending platform 14 welded to the stiles. The platform 14 is formed from metal having non-slip ribs 15 thereon, and is flanked on each side by platform wings 16.

A support stay sub-assembly 20 comprises a pair of support stays 21 which are hinged by hinges 22 to the platform wings, and above and rearwardly of the support stay hinges 22 there are safety rail hinges 23 by which a safety rail 24 is also hinged to the platform 14. The safety rail 24 comprises a loop-like frame, having two side frame members 25, and upper bridge 26, and a lower bridge 27. When in its retracted position as shown in FIG. 1, side frame members 25 overlie the platform between the platform wings 16 and project forwardly thereof, so that the safety rails 24 must be moved by an operator to its safety (vertical) position if the operator wishes to make use of the platform.

In order to retain the safety rail in its safety position there is provided a spring loaded latch 30 having a inclined surface 31 engaged by the lower horizontal bridge 27 of the safety rail 24 as the safety rail reaches its safety in-use vertical position. The latch 30 is carried on a latch bar 32 which extends transversely between brackets 33 on the support stays 21 in which the latch bar hinges, and the latch 30 is also provided with a release knob 34 which enables it to be lifted to a release position for retraction of the safety rail. The latch maintains the lower end of the safety rail 24 firmly against the upper ends of the support stays 21, until released by release knob 34.

In order to simplify operation of the safety rail, a spring counter balance assembly 36 extends between the safety rail 24 and the platform 14, this comprising a tension spring 37 carried in concentric telescopic tubes 38, the tension spring 37 partly counterbalancing the weight of the rail.

I claim:

1. A ladder comprising a ladder portion having stiles, rungs extending between the stiles, a platform joining the upper ends of the stiles and extending rearwardly therefrom, support stays, first hinge means joining the upper ends of the support stays to the rear end of the platform, a safety rail, further hinge means also joining the safety rail to the rear end of the platform so that the safety rail is movable between an in-use position where it extends upwardly from said platform rear end, and retracted position where it projects forwardly of the platform.

2. A ladder according to claim 1 further comprising a releasable latch which retains the lower end of the safety rail firmly against the upper ends of the support stays, when the rail is in its in-use position.

3. A ladder according to claim 1 wherein said platform comprises side wings, said further hinge means being upwardly and rearwardly of said first hinge means, both said hinge means being on the rear ends of said side wings.

4. A ladder according to claim 3 wherein said safety rail comprises a loop-like frame having two side frame members, an upper bridge and a lower bridge, the side frame members overlying the platform between its wings when the platform is in its retracted position, said further hinge means being on respective said side frame members near their lower ends.

5. A ladder according to claim 1 further comprising a counter balance spring between the lower end of safety rail and the ladder portion.

* * * * *

UNITED STATES PATENT AND TRADEMARK OFFICE

CERTIFICATE OF CORRECTION

PATENT NO. : 4,620,611

DATED : November 4, 1986

INVENTOR(S) : John C. Good

It is certified that error appears in the above-identified patent and that said Letters Patent is hereby corrected as shown below:

Claim 1, line 45, column 2, after the word "and", insert --a--.

Signed and Sealed this

Twenty-first Day of April, 1987

*Attest:*

DONALD J. QUIGG

*Attesting Officer*

*Commissioner of Patents and Trademarks*